US008242905B2

(12) United States Patent
Gerner et al.

(10) Patent No.: US 8,242,905 B2
(45) Date of Patent: Aug. 14, 2012

(54) SYSTEM AND METHOD FOR ADJUSTING A SECURITY LEVEL AND SIGNALING ALARMS IN CONTROLLED AREAS

(75) Inventors: Nathan J. Gerner, Waukesha, WI (US); Thomas P. Schmit, Huntington, NY (US)

(73) Assignee: Honeywell International Inc., Morristown, NJ (US)

( * ) Notice: Subject to any disclaimer, the term of this patent is extended or adjusted under 35 U.S.C. 154(b) by 484 days.

(21) Appl. No.: 12/410,613

(22) Filed: Mar. 25, 2009

(65) Prior Publication Data

US 2010/0245087 A1 Sep. 30, 2010

(51) Int. Cl.
*G08B 13/00* (2006.01)

(52) U.S. Cl. ..... 340/541; 340/568.2; 340/5.83

(58) Field of Classification Search ..... 340/541, 340/545.1, 545.3, 565, 568.2, 5.8, 5.81, 5.82, 340/5.83
See application file for complete search history.

(56) References Cited

U.S. PATENT DOCUMENTS

| | | | | |
|---|---|---|---|---|
| 5,650,800 | A * | 7/1997 | Benson | 345/173 |
| 5,992,094 | A * | 11/1999 | Diaz | 49/31 |
| 7,295,119 | B2 * | 11/2007 | Rappaport et al. | 340/572.4 |
| 2007/0008111 | A1 * | 1/2007 | Tice et al. | 340/539.12 |
| 2007/0083915 | A1 * | 4/2007 | Janakiraman et al. | 726/4 |
| 2007/0140494 | A1 * | 6/2007 | Kumoluyi et al. | 380/270 |
| 2008/0086758 | A1 * | 4/2008 | Chowdhury et al. | 726/2 |

* cited by examiner

*Primary Examiner* — Daniel Previl
(74) *Attorney, Agent, or Firm* — Husch Blackwell

(57) ABSTRACT

A system including at least one sensor capable of indicating the physiological presence an individual proximate thereto, an access control unit associated with the sensor that provides physiological access to a secure area and control circuits coupled to the at least one sensor, and the unit and responsive thereto to adjust a security level and alarm state in a selected region of the secure area.

20 Claims, 7 Drawing Sheets

STAND-ALONE DOOR CONTROLLER SYSTEM

STAND-ALONE DOOR CONTROLLER SYSTEM

DOOR CONTROLLER SYSTEM WITH ACCESS CONTROL HOST

| SYSTEM FUNCTIONALITY | RESULTING SYSTEM STATE |
|---|---|
| THE SECURITY LEVEL OF AN AREA AND ITS SUB-AREAS MAY REMAIN CONSTANT IF AUTHORIZED PERSONNEL ARE MOVING IN THE AREA |   |

| SYSTEM FUNCTIONALITY | RESULTING SYSTEM STATE |
|---|---|
| THE SECURITY LEVEL OF SUB-AREAS MAY BE CONTROLLED BY THE PRESENCE OF A PARTICULAR AUTHORIZED INDIVIDUAL |   |

| SYSTEM FUNCTIONALITY | RESULTING SYSTEM STATE |
|---|---|
| A HIGH SECURITY AREA OR SUB-AREAS MAY BE LOCKED DOWN IF AN UNAUTHORIZED CARD HOLDER ENTERS THE AREA |   |

| SYSTEM FUNCTIONALITY | RESULTING SYSTEM STATE |
|---|---|
| AN AREA OR GROUP OF AREAS MAY INCREASE THE SECURITY LEVEL UPON THE DETECTION OF AN INTRUDER |   |

| SYSTEM FUNCTIONALITY | RESULTING SYSTEM STATE |
| --- | --- |
| AN AREA MAY INCREASE IN SECURITY LEVEL OR AN ALARM MAY BE RAISED UPON THE TRIGGERING OF A 'DISTRESS' EVENT |   |

SYSTEM AND METHOD FOR ADJUSTING A SECURITY LEVEL AND SIGNALING ALARMS IN CONTROLLED AREAS

FIELD

The invention pertains to regional access control systems and methods. More particularly, the invention pertains to such systems and methods where individuals in a region are sensed and identified and responsive thereto, a security level and alarm state of the region can be adjusted.

BACKGROUND

Various types of door, or, regional access control systems are known. One such system is disclosed in US Published Patent Application No. 2008/0086758 A1 published Apr. 10, 2008 and entitled, "Decentralized Access Control Framework." The '758 application is assigned to the Assignee hereof and incorporated by reference.

While known systems have been effective for their intended purpose, open issues remain. For example, traditional access control systems can not detect if an unauthorized cardholder has 'piggybacked' into a secure area, and thus they do not increase the level of security in the area and sub-areas. Further, known intrusion systems can identify if a person is in a secure area, but they can not accurately identify whether the person is a valid cardholder. This problem may occur when an employee is working late, and the intrusion system is turned on while he/she is still in the building or region being monitored. Finally, if the intrusion system is set up to disarm when a valid card holder enters an area, then the level of security in that area is reduced.

In would be desirable to address the above noted issues so as to provide more effective security to a monitored region than is currently available. It would also be desirable to do so in a way such that existing systems might be upgradable.

DETAILED DESCRIPTION

Figure 1:
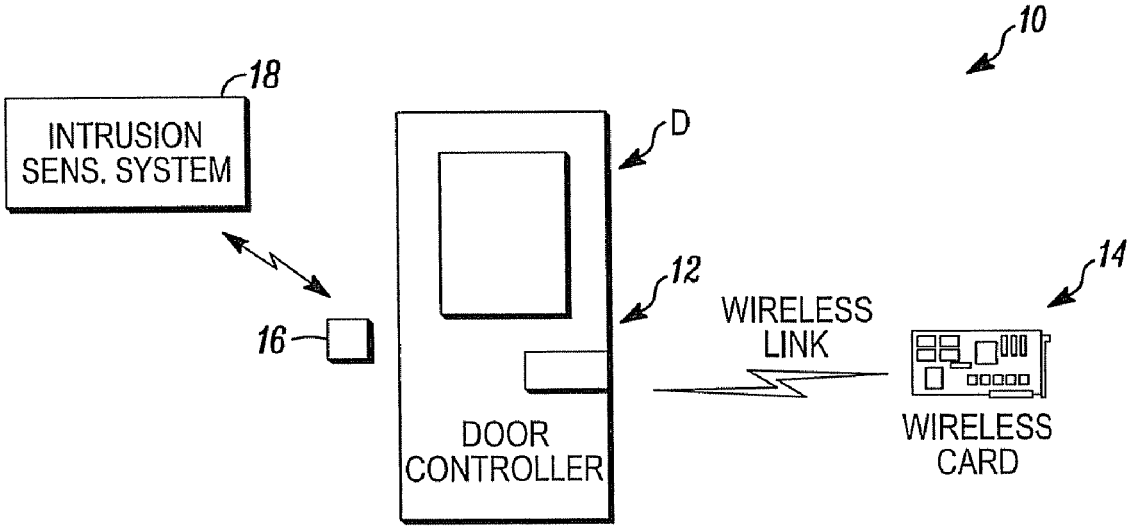
FIG. 1 is a diagram of a stand-alone access control system which embodies the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In a disclosed embodiment of the invention, card holders and intruders within an area are identified. Identified individuals can be classified as authorized, unauthorized or an unrecognized intruder. Control of the area, or, region can then be based on the identification and classification of the individual(s).

A method which embodies the invention classifies individuals as they enter, exit, and are present in monitored areas with different levels of security and alarm states. In accordance therewith, situations can be automatically established in which certain alarm states may be indicated, and the security level of an area may be raised or lowered automatically.

A system which embodies the invention identifies known personnel as they pass through one or more areas. Access can be provided by various forms of credentials. These include without limitation, contact-type or wireless access cards, or physiological characteristics or the like, all without limitation.

For example, battery-assisted passive (BAP) access cards can be used without departing from the spirit and scope of the invention. Such access cards can communicate with door controllers as well as access points in an area. If an access card is communicating with an access point, then it is assumed that the card holder is within a predefined area of the access point. Other forms of identification devices come within the spirit and scope of the invention.

In another example, physiological, or biometric, identification devices such as solid state cameras can be used without departing from the spirit and scope of the invention. Such identification devices can communicate with video surveillance controllers which process physiological data of individuals in an area. If the physiological data of an individual in an area matches pre-recorded data of a known individual, then it is assumed that a card holder is within a predefined area of the physiological identification device.

Additionally, the presence of a person within a given area, regardless of whether or not they are a card holder can be established. Motion, or, intrusion sensors can be incorporated in accordance with the invention. The intrusion sensor or sensors is/are positioned to monitor the same area as a corresponding access point or door controller. Hence, motion around an access point or door may be detected.

In accordance with an embodiment of the invention, areas and sub-areas that are monitored by both an access point and an intrusion sensor can be defined. When the intrusion sensor detects a person in the area, the system can place the individual into one of three categories:

An authorized individual is a person carrying a valid credential, such as a card, and is allowed in the area;

An unauthorized individual is a person carrying an identifiable credential, or card, but is not allowed in the area; and An unrecognized individual is a person without a credential, such as an intruder.

Depending on the categorization of the individual embodiments of the invention can control the alarm state or change a security level of an area or group of areas. For example, the security level of an area and its sub-areas may remain constant if authorized personnel are moving in the area. In an aspect of the invention, an intrusion alarm system for an area would not need to be disabled when valid personnel are in the area. Any event generated from the movement of authorized personnel would be shunted and not emitted or transmitted to a common control unit or other control units, such as an intrusion controller or video surveillance controller.

In yet another aspect of the invention, the security level(s) of sub-areas may be controlled by the presence of a particular authorized individual. For example, the security level of a medicine cabinet in a pharmacy may decrease when the supervisor is within a certain distance of the cabinet, and this decrease may unlock the cabinet or allow access to trainees. The security level may then automatically increase again when the supervisor walks away from the cabinet.

In a further aspect of the invention, a high security area or sub-area may be locked down if an unauthorized person enters the area. For example, an unauthorized person may 'piggyback' on an authorized person through a portal and gain access to a secure area. If this occurs, in accordance with the invention, the security level of the area can automatically be increased to the level of 'lockdown' in the secure area and its sub-areas. Alternatively, the coverage and responses of intrusion alarm and video surveillance controllers may be altered if an unauthorized person is in a secure area.

Alternately, systems or methods which embody the invention can increase the security level of an area or group of areas upon the detection of an intruder. This event occurs when motion is detected in an area, and there is not an authorized individual in the area. The security level may increase to the level of 'lockdown,' and an alarm may be raised.

In another embodiment, a security level may be increased, or, an alarm may be raised in an area, or region in response to the triggering of a 'distress' or personal emergency event. Such events are often manually triggered by an individual needing emergency assistance in response to accidental physical danger or intentional violence. However these events may also be triggered by the occurrence of personal industrial hazards such as the activation of fall arresting gear. Distress events may be triggered in other various ways as would be understood by those of skill in the art.

In yet another embodiment, the security levels may be controlled between areas to prevent the interaction of a threat with credential carrying personnel. The threat may be identified through the intrusion system or a supplementary system that generates known alarms. For example, if a fire is identified in an area of a building, then the security level may be controlled so that credential carrying personnel may only exit the area and not enter it. The security level of other areas may also be controlled, which would funnel all credential carrying personnel to safety in the quickest way possible. Other examples of threats that may initiate this automated security level control could include armed intruders, chemical spills or contamination, all without limitation. Likewise the security level of other areas may also be controlled, so as to enable the access and infrastructure (e.g. lighting, HVAC, etc.) needed by emergency responders to such events in order to re-establish security and/or safety.

FIG. 1 illustrates one form of a stand-alone system 10 which embodies the invention. In system 10, a wireless door controller is mounted on a door D to control access to a region which is closed, or blocked by the door D. A wireless card 14 can be used to cause controller 12 to release, or unlock door D for access by an individual in possession of card 14.

In a stand alone mode, as in FIG. 1, an associated sensor 16 of an intrusion detection system 18 can detect the presence of one or more individuals/intruders in the vicinity of the door D. As discussed below, sensor 16 could be incorporated into controller 12 which could be coupled to system 18 wirelessly or via a wired medium.

Figure 2:
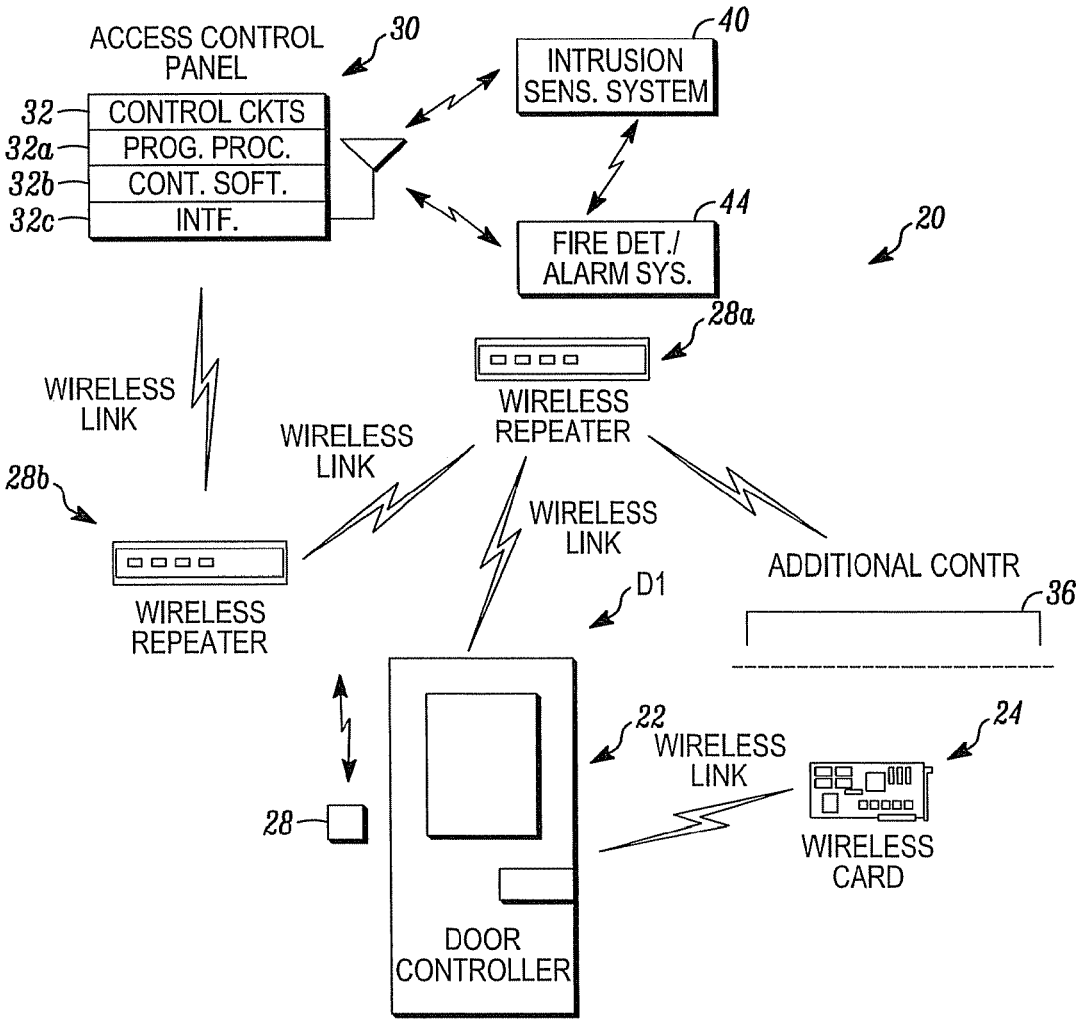
FIG. 2 is a diagram of a multi-controller system which embodies the invention.

FIG. 2 illustrates a multiple door/region access control system 20. System 20 includes a wireless door controller 22 carried by a door D1 which provides access to a respective region.

Controller 22, in addition to responding to a wireless access card 24 to provide access to the respective region, can also be in wireless communication, via repeaters 28*a,b* with a control unit or panel 30. It will be understood that controller 22 can operate substantially in a stand-alone mode and provide access via door D1 and feed access related data to unit 30, or can communicate information as to card 24 to unit 30 to obtain authorization to release door D1, all without limitation.

Control unit 30 can include control circuits 32. Circuits 32 can be implemented in part by a programmable processor 32*a*, associated control software 32*b*, executed by processor 32*a* and a wireless interface 32*c* for communication with controller 22. System 20 can also include a plurality of additional controllers, indicated generally at 36, which provide access to different regions than does controller 22.

One or more intrusion sensors, such as motion sensor 28 can be located in the vicinity of access controller 22, or configured as part of controller 22. Sensors such as sensor 28 can be coupled to an intrusion sensing system, such as system 40 which can also be in communication with control panel 30. A fire alarm system, such as 44, coupled to one or both systems 30, 40 can provide audible/visible alarms in the region being monitored indicative of detected individuals in the absence of authorization.

Figure 3:
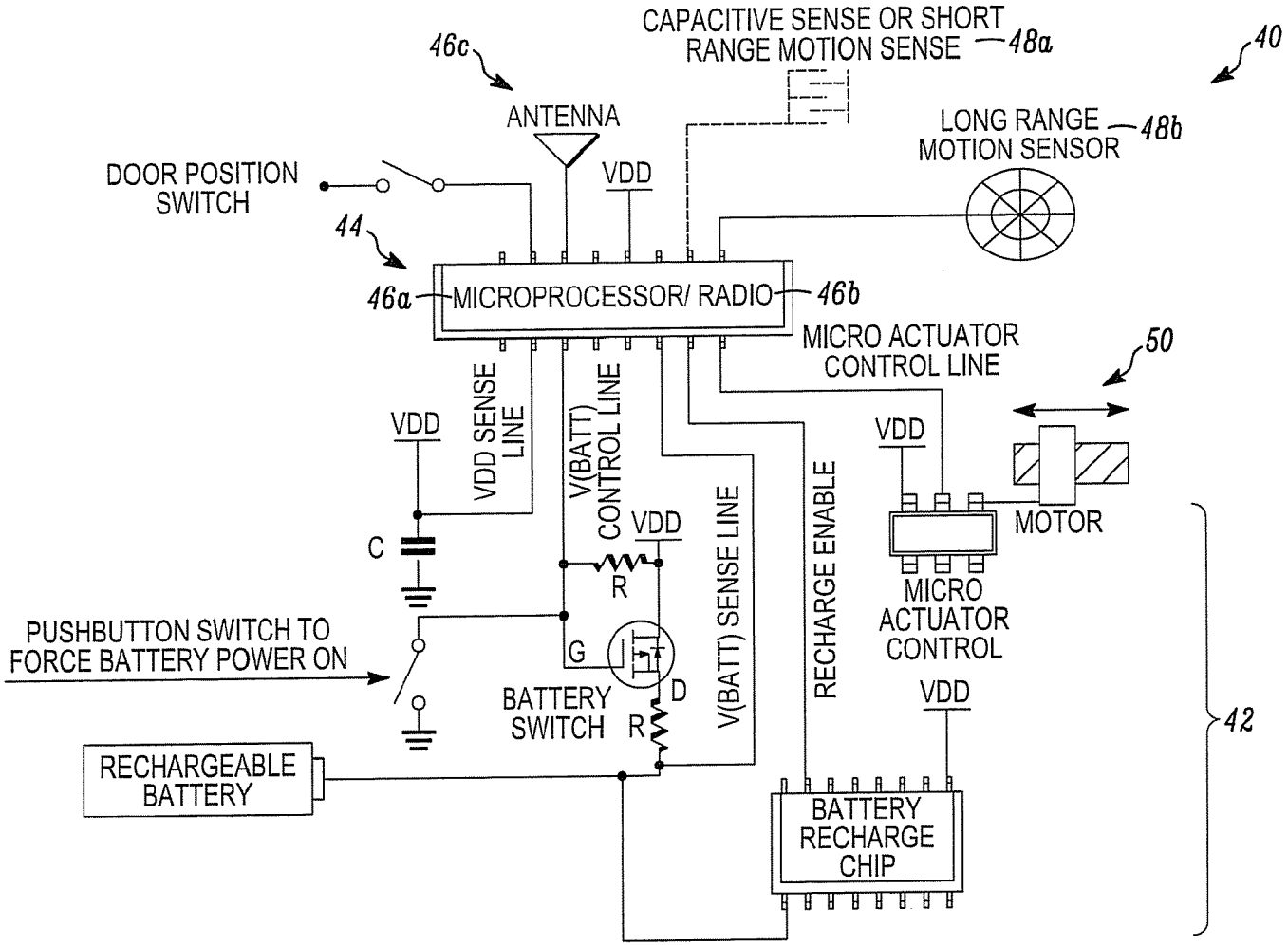
FIG. 3 a block diagram of a door mountable access control unit which can be used in the systems of FIG. 1 or 2.

FIG. 3 is a block diagram of an exemplary controller 40, comparable to controllers 20, 22, 36. Controller 40 can include a door mountable housing 42. Housing 42 can carry control circuits 44 which can include a programmed processor 46*a* and associated radio or transceiver 46*b* for wireless communication via antenna 46*c*.

Housing 42 can also carry a short range capacitive motion sensor 48*a* and a longer range motion sensor, for example a passive infra-red-type sensor 48*b*. Other types of sensors of individuals, such as thermal sensors, solid state cameras with associated processing to detect motion, without limitation, come within the spirit and scope of the invention. Further as noted above, such sensors can but need not be incorporated into the respective access control unit.

Outputs from one or both sensors 48 *a, b* in combination with information from an associated wireless card, such as 14, or 24, can be used by circuitry 44 to determine if a respective door, such as D or D1 should be released, or access levels changed, as described above in accordance with the invention. Such sensors can also be used, in combination with local processing, or processing by intrusion sensing system 40 in identifying intruders. Where motion as been sensed, but no authorized credential carrying personnel are in the area, the motion would have been caused by an intruder.

It will be understood that the controller 40 is exemplary only and other variations or configurations, including wired controllers come within the spirit and scope of the invention. Similarly, the particular details of the type of card being used to obtain access are not limitations of the invention. For example, RFID-type cards as well as optical or magnetic cards all come within the spirit and scope of the invention.

Figure 4:
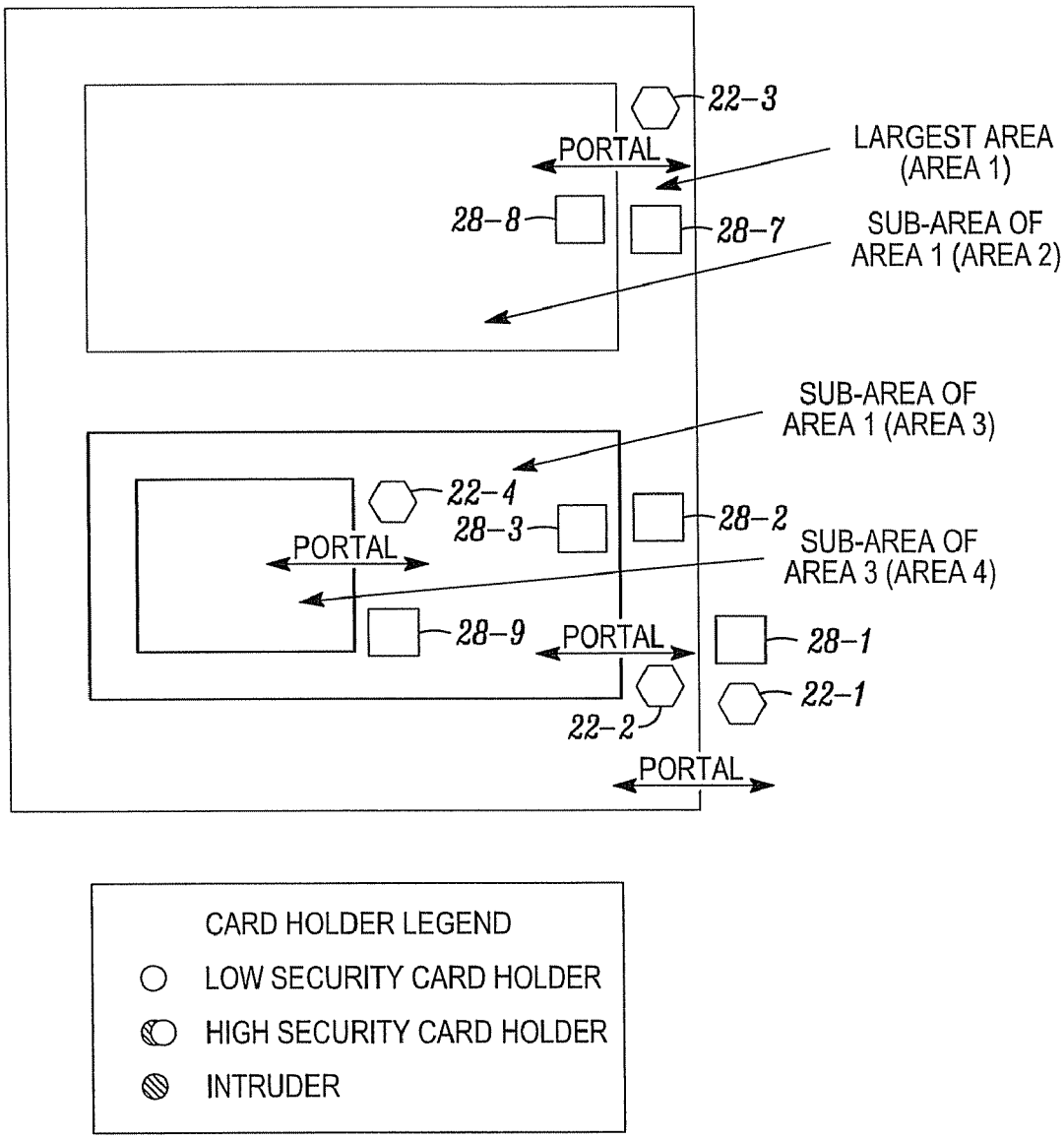
FIG. 4 a diagram of a monitored region illustrating details of the present invention.

FIGS. 4-9 illustrate methods, or processing which embody the present invention and which could be carried out by controllers, such as controller 40. FIG. 4 illustrates multiple controlled areas, or, regions. Areas 1, 2 represent relatively low security areas. Areas 3, 4 represent higher security areas. Areas 1-4 are accessed by respective Portals which provide access via one or more respective doors, such as D, or D1. Each of the portals has an associated access control system, such as the unit 22-I, and at least one local intrusion or motion sensor, such as 28-I as discussed above relative to FIGS. 2, 3.

The access control units 22-I could be coupled (wired or wirelessly) to control unit 30. The intrusion sensors could be coupled to system 40, discussed above. Sensors 28-I can be included in, or displaced from respective access control units 22-*i*. As would be understood by those of skill in the art, multiple intrusion sensors can be installed throughout areas 1-4 as appropriate without departing from the spirit and scope of the invention. Regions illustrated in FIGS. 5-9 include the access control units and intrusion sensors as illustrated in FIG. 4.

Figure 5:
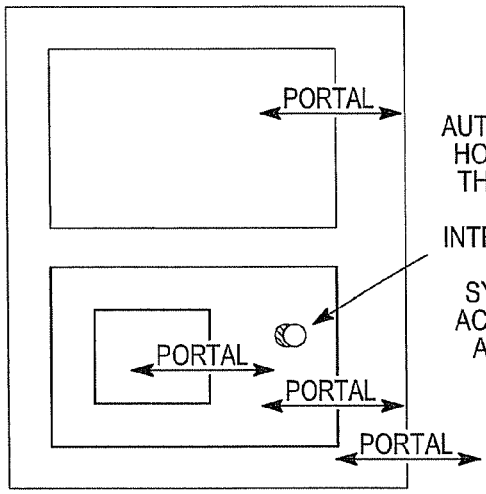
FIGS. 5-9 illustrate aspects of processing by control units, such as in FIG. 3, which embody the present invention.

FIG. 5 illustrates that the security level of an area and its sub-areas can be maintained constant in the presence of an authorized individual, or, card holder. A sensor such as 28-*i* in combination with information from a respective card such as 24 and access control unit 22-I can enable the card holder to enter a region with an active intrusion alarm without setting off the alarm.

Figure 6:
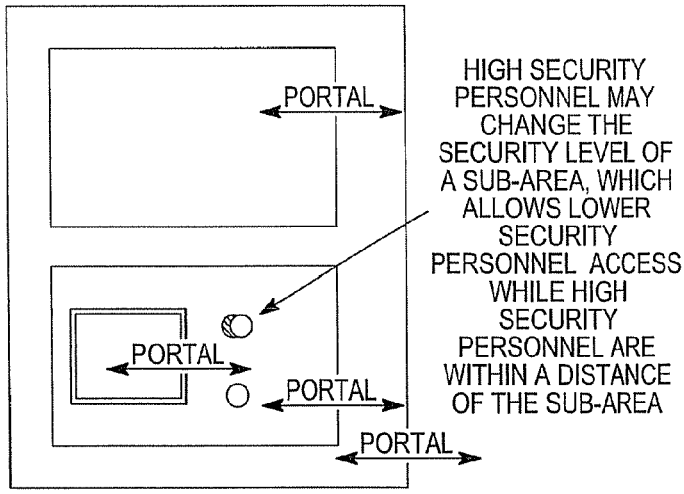

FIG. 6 illustrates control of the security level of a sub-area in response to the present of an authorized individual. An individual with a higher security level can alter the security level of a sub-area thereby enabling someone of a lower security level to have access to an internal, higher security region but only when in the presence of the person having a high security level.

Figure 7:
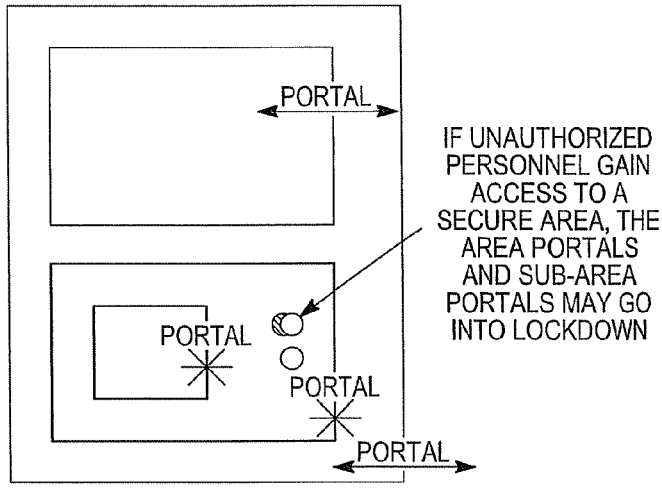
Figure 8:
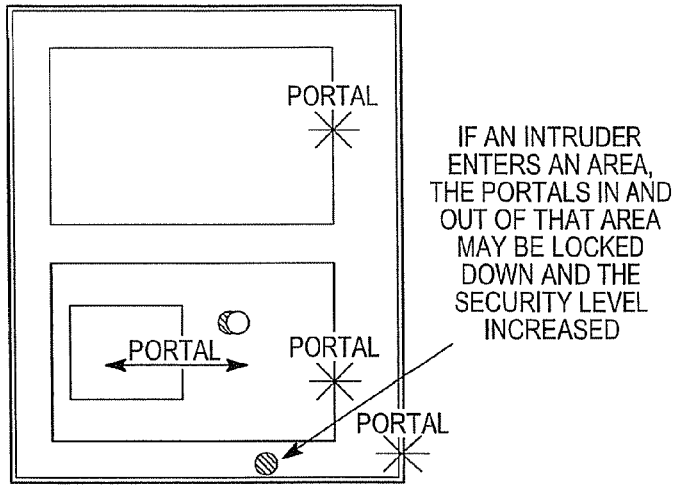
Figure 9:
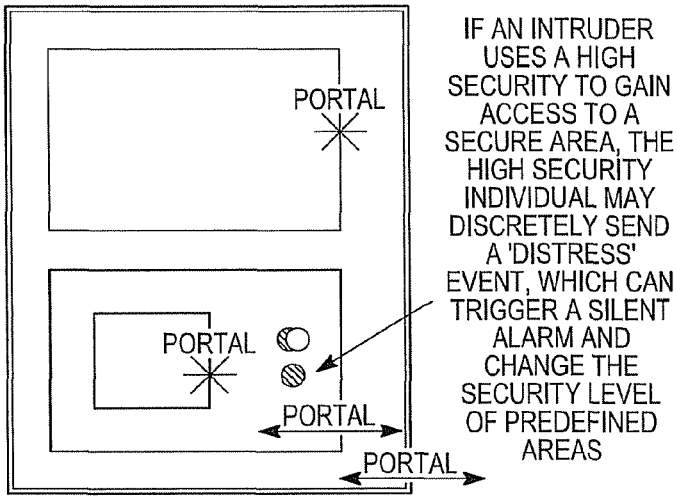

FIG. 7 illustrates locking down a high security area or sub-area(s) in response to an unauthorized card holder entering the area, perhaps along with a person having a higher security level. FIG. 8 illustrates locking down and increasing the security level of an area upon detection of an intruder. FIG. 9 illustrates increasing security in an area or generating an alarm where an intruder uses proximity to a higher security individual to gain access to a secure area, and the higher security level individual can create a "distress event" alerting the unit 40.

Alternatives to the card based access control units, such as 22-*i*, also come within the spirit and scope of the invention. These include without limitation, access control units with key pads, or that recognize one or more physiological, or biometric, characteristics of an individual such as fingerprints, retinal prints, facial characteristics, speech and the like all without limitation. Sensors can include video, or other forms of cameras without limitation.

Thus embodiments of the invention can sense that an individual is present. The individual can then be identified. One or more sensors can be used without departing from the spirit and scope of the invention. The details of such sensors are not limitations of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

at least one sensor that indicates the physiological presence of an individual person proximate thereto;

an access control unit associated with the sensor that provides physiological access by the individual person into a secure area; and control circuits coupled to the at least one sensor, and the access control unit that detects the physiological presence of a person within the secure area, identifies the person and responsive to the physical danger to individuals within the secure area, adjusts a security level and alarm state in a selected region of the secure area where the detected and identified person is located.

2. A system as in claim 1 where the control circuits can increase the security level in a region in response to the detected presence of a recognized person having a first clearance level.

3. A system as in claim 1 where the control circuits can decrease the security level in a region in response to the detected presence of a recognized person having a first clearance level.

4. A system as in claim 1 where the access control unit identifies the individual and, responsive to the entrance of an authorized individual into the region, the state of an associated alarm system is unchanged.

5. A system as in claim 1 where, responsive to the presence of first and second individuals in the region, and with one individual having a higher clearance than the other, a security level of an internal sub-region is reduced.

6. A system as in claim 5 where access to the sub-region is limited by an access apparatus which includes: at least one sensor capable of indicating the presence of an individual proximate thereto; an access control unit associated with the sensor; and control circuits coupled to the sensors, and responsive thereto to adjust a security level in the sub-region.

7. A system as in claim 6 where the sensing of an individual proximate thereto comprises at least one sensor capable of indicating the presence and identity of the individual, such as a motion sensor, thermal sensor, pressure sensor, physiological sensor, or solid state camera.

8. A system as in claim 1 where the control circuits respond to the presence of an unauthorized individual in a region by altering a security level of at least one selected region.

9. A system as in claim 1 where the control circuits respond to the presence of an intruder in a region by altering a security level of at least one selected region and by authorizing access into some regions and not others.

10. A system as in claim 1 where the control circuits respond to the presence of at least an authorized individual in a region and a detected security and/or safety indicium by increasing a security level in one or more selected regions and changing a selected alarm state.

11. A method comprising:

defining a region having a first security level;

establishing an intrusion alarm in a first state with respect to the region;

sensing an indicium authorizing physiological access by an individual into the region, and responsive thereto, permitting physiological access to the region via a selected physiological sensor;

detecting the physiological presence of a person within the region;

identifying the detected person as the authorized individual; and indicating the physiological presence and identity of the individual in the vicinity of the sensor and responsive to the physical danger within the region, maintaining the intrusion alarm in the first state.

12. A method as in claim 11 which includes sensing the presence of first and second individuals in the vicinity of a selected sensor, and temporarily reducing the security level of a region accessible via the sensor in response to one of the individuals having a higher security level than the other.

13. A method as in claim 12 where the security level is reduced only as long as the individual having the higher security level continues to be sensed in the vicinity of the other individual.

14. A method as in claim 11 which includes sensing an unauthorized individual in a region and responsive thereto, not authorizing the departure of the individual from the region and initiating a selected intrusion alarm state.

15. A method as in claim 11 which includes sensing a distress event and generating a selected alarm state while altering a security level of a respective region.

16. A method as in claim 11 which includes sensing a condition indicative of security and/or safety in a region, and responsive thereto, altering security levels of respective regions to either contain individuals and the condition, to enable individuals to depart where they would not otherwise be allowed to leave, or enable access by authorized personnel for the purpose of restoring some level of security and/or safety.

17. A method as in claim 16, where security levels of multiple regions may be altered to provide a path to safety from or around the condition, or enable access by authorized personnel for the purpose of restoring some level of security and/or safety.

18. A method as in claim 16 which includes generating one or more condition indicating alarms and generating one or more indicators of at least one escape path from or to the condition.

19. A method of categorizing individuals within at least one region to various levels of authorization including unauthorized or intruder, the method comprising: physiologically sensing a condition indicative of a breach of security and/or safety in a region by detecting the physiological presence of a person within the at least one region, identifying the detected person as an authorized individual, and responsive to the physical danger within the region, altering security levels of respective regions to either contain authorized individuals and the condition to enable authorized individuals to only exit the respective regions and not enter the respective regions, or physiologically enable access by authorized personnel for the purpose of restoring a selected level of security and/or safety.

20. A method as in claim 19 and where security levels of multiple regions may be altered to provide a path to safety from or around the condition, or enable access by authorized personnel for the purpose of restoring a selected level of security and/or safety.

* * * * *